US007012582B2

(12) United States Patent
Russ et al.

(10) Patent No.: US 7,012,582 B2
(45) Date of Patent: Mar. 14, 2006

(54) SPACER-LESS FIELD EMISSION DISPLAY

(75) Inventors: Benjamin Edward Russ, San Diego, CA (US); Jack Barger, San Diego, CA (US)

(73) Assignees: Sony Corporation, Tokyo (JP); Sony Electronics Inc., Park Ridge, NJ (US)

( * ) Notice: Subject to any disclaimer, the term of this patent is extended or adjusted under 35 U.S.C. 154(b) by 247 days.

(21) Appl. No.: 10/306,172

(22) Filed: Nov. 27, 2002

(65) Prior Publication Data

US 2004/0100184 A1 May 27, 2004

(51) Int. Cl.
*G09G 3/20* (2006.01)

(52) U.S. Cl. ..... 345/74.1; 345/75.1; 313/495

(58) Field of Classification Search ..... 345/74.1, 345/75.1, 75.2; 313/495, 496, 497
See application file for complete search history.

(56) References Cited

U.S. PATENT DOCUMENTS 3,665,241 A 5/1972 Spindt et al.
4,591,758 A 5/1986 Barth et al.
4,857,161 A 8/1989 Borel
4,940,916 A 7/1990 Borel
5,019,003 A 5/1991 Chason
5,053,673 A 10/1991 Tomii et al.
5,063,327 A 11/1991 Brodie et al.
5,070,282 A 12/1991 Epsztein
5,216,324 A 6/1993 Curtin
5,245,247 A 9/1993 Hosogi
5,311,360 A 5/1994 Bloom et al.
5,340,997 A 8/1994 Kuo
5,448,133 A 9/1995 Ise
5,473,222 A 12/1995 Thoeny et al.
5,508,584 A 4/1996 Tsai et al.
5,528,103 A 6/1996 Spindt et al.
5,548,185 A 8/1996 Kumar et al.
5,556,316 A 9/1996 Taylor
5,561,345 A 10/1996 Kuo
5,565,742 A 10/1996 Shichao et al.
5,587,628 A 12/1996 Kuo
5,614,785 A 3/1997 Wallace
5,619,097 A 4/1997 Jones
5,649,847 A 7/1997 Haven
5,688,708 A * 11/1997 Kato et al. ..... 445/25

(Continued)

OTHER PUBLICATIONS

PCT /US03/36758 International Search Report. Oct. 1, 2004. Sony Corporation.

(Continued)

*Primary Examiner*—Richard Hjerpe
*Assistant Examiner*—Ke Xiao
(74) *Attorney, Agent, or Firm*—Thomas F. Lebens; Fitch, Even, Tabin & Flannery

(57) ABSTRACT

Field emission displays (FEDs) having improved structure are provided. In one implementation, a field emission display comprises a faceplate, a backplate, a volume formed therebetween and maintained as a vacuum, a cathode and an anode. A thickness of the faceplate and the backplate are sufficient to prevent deformation of the faceplate and the backplate across their dimensions due to the vacuum such that spacers are not needed to maintain a uniform separation between the anode and the cathode. In an alternative implementation, the volume includes a first portion between the cathode and the anode and a second portion between the cathode and the backplate, the second portion continuous with the first portion. The second portion provides an improved volume to surface area ratio, which improves vacuum quality and which allows for improved gettering, which again allows for improved vacuum quality and longer display lifetime.

30 Claims, 8 Drawing Sheets

U.S. PATENT DOCUMENTS 5,689,151 A 11/1997 Wallace
5,717,287 A 2/1998 Amrine
5,773,921 A 6/1998 Keesmann et al.
5,789,848 A * 8/1998 Dworsky et al. ..... 313/310
5,811,926 A 9/1998 Novich
5,827,102 A * 10/1998 Watkins et al. ..... 445/25
5,834,891 A 11/1998 Novich
5,838,103 A 11/1998 Park
5,880,554 A 3/1999 Liu
5,910,704 A 6/1999 Choo
5,949,394 A 9/1999 Kishino
5,962,959 A 10/1999 Iwasaki
5,977,703 A 11/1999 Ju et al.
5,986,390 A 11/1999 Chuman
5,986,625 A 11/1999 Huang
6,004,912 A 12/1999 Gudeman
6,027,388 A 2/2000 Jones et al.
6,031,328 A 2/2000 Nakamoto
6,039,622 A 3/2000 Kosaka et al.
6,064,148 A 5/2000 Tolt et al.
6,066,922 A 5/2000 Iwasaki
6,094,001 A 7/2000 Xie
6,097,138 A 8/2000 Nakamoto
6,136,621 A 10/2000 Jones et al.
6,144,144 A 11/2000 Cleeves et al.
6,146,230 A 11/2000 Kim et al.
6,149,484 A 11/2000 Amrine et al.
6,153,969 A 11/2000 Levine
6,172,456 B1 1/2001 Cathey et al.
6,175,346 B1 1/2001 Chiu et al.
6,194,333 B1 2/2001 Ryu
6,323,831 B1 11/2001 Ono et al.
6,335,728 B1 1/2002 Kida et al.
6,354,898 B1 3/2002 Kim
6,359,383 B1 3/2002 Chuang et al.
6,377,002 B1 4/2002 Ge et al.
6,486,597 B1 11/2002 Goel et al.
6,489,710 B1 12/2002 Okita et al.
6,509,677 B1 1/2003 Xia et al.
6,515,429 B1 2/2003 Russ et al.
6,559,602 B1 5/2003 Russ et al.
6,583,549 B1 6/2003 Takenaka et al.
6,590,320 B1 7/2003 Abanshin et al.
6,624,590 B1 9/2003 Russ et al.
6,650,061 B1 11/2003 Urayama
6,663,454 B1 12/2003 Russ et al.
6,670,747 B1 12/2003 Ito
6,682,382 B1 1/2004 Russ et al.
6,747,416 B1 6/2004 Barger et al.
6,756,730 B1 6/2004 Russ et al.
6,774,548 B1 8/2004 Fran et al.
6,791,278 B1 9/2004 Russ
6,798,143 B1 9/2004 Frayssinet
2001/0028215 A1 10/2001 Kim
2001/0035712 A1 11/2001 Berman et al.
2002/0047559 A1 4/2002 Frayssinet
2002/0185950 A1 12/2002 Russ et al.
2002/0185951 A1 12/2002 Russ et al.
2002/0185964 A1 12/2002 Russ et al.
2002/0187706 A1 12/2002 Russ et al.
2002/0187707 A1 12/2002 Russ et al.
2002/0195959 A1 12/2002 Russ et al.
2003/0052873 A1 3/2003 Ueda
2003/0193296 A1 10/2003 Russ et al.
2003/0193297 A1 10/2003 Russ et al.
2003/0201721 A1 10/2003 Veillette et al.
2004/0007988 A1 1/2004 Barger et al.
2004/0075379 A1 4/2004 Jin
2004/0090163 A1 5/2004 Russ et al.
2004/0104667 A1 6/2004 Russ et al.
2004/0145299 A1 7/2004 Wang et al.
2004/0189552 A1 9/2004 Russ et al.
2004/0189554 A1 9/2004 Russ et al.

OTHER PUBLICATIONS

PCT/US03/11818. International Search Report. Sony Electronics, Inc. Oct. 9, 2003.
PCT/US03/11410. International Search Report. Sony Electronics, Inc. Apr. 5, 2004.
Beer, "The Sony Trinitron Tube," *Television*. Apr. 1989. pp 406-408. vol. 39 No. 6.
Bloom, "The Grating Light Valve: revolutionizing display technology," Silicon Light Machines. Oct. 1, 2002. pp 1-21. Retrieved from http://www.siliconlight.com/webpdf/pw97.pdf.
Gudeman, "Diffractive Optical MEMs Using Grating Light Value Technique," *EE Times*. Mar. 18, 2002. pp1-4. Retrieved from www.eetimes.com/in_focus/communications/OEG20020315S0047.
Yamada, "A New High-Resolution Trinitron Color Picture Tube for Display Application," *IEEE: Transactions on Consumer Electronics*. Aug. 1980. pp 466-473. vol. CE-26 No. 3.
U.S. Appl. No. 10/350,661, filed Jan. 24, 2003, Wang et al.
U.S. Appl. No. 10/404,945, filed Mar. 31, 2003, Russ et al.
U.S. Appl. No. 10/404,712, filed Mar. 31, 2003, Russ et al.
U.S. Appl. No. 10/772,852, filed Nov. 25, 2003, Russ et al.
Candescent Technologies, *ThinCRT Showcase*, http://www.candescent.com/Candescent/showcase.htm, Jan. 16, 2001, pp. 1-4. Candescent Technologies Corporation.
Candescent Technologies, *ThinCRT Technology*, http://www.candescent.com/Candescent/tcrttch.htm, Jan. 16, 2001, pp. 1-3, Candescent Technologies Corporation.
Candescent Technologies, *The ThinCRT Concept*, http://www.candescent.com/Candescent/tcrtcnpt.htm, Jan. 16, 2001, pp. 1-6, Candescent Technologies Corporation.
Candescent Technologies, *Candescent ThinCRT Technology Primer*, http://www.candescent.com/Candescent/techprim.htm, Jan. 16, 2001, pp. 1-5, Candescent Technologies Corporation.
Ito et al, *Carbon-Nanotube-Based Triode-Field-Emission Displays Using Gated Emitter Structure*, IEEE Electron Device Letters, Sep. 2001, pp. 426-428, vol. 22, No. 9.
U.S. Appl. No. 60/405,588, filed Aug. 23, 2002, inventor, Jin

* cited by examiner

SPACER-LESS FIELD EMISSION DISPLAY

BACKGROUND OF THE INVENTION

1. Field of the Invention

The present invention relates generally to flat panel displays (FPDs), and more specifically to field emission displays (FEDs). Even more specifically, the present invention relates to supporting a faceplate of an FED under vacuum.

2. Discussion of the Related Art

A field emission display (FED) is a low power, flat cathode ray tube type display that uses a matrix-addressed cold cathode to produce light from a screen coated with phosphor materials. FEDs provide a relatively thin display device that can achieve CRT-like performance; however, FEDs are inherently difficult to manufacture.

Typically, an FED includes a cathode plate containing an electron emitting surface that when driven, emits electrons toward a thin glass faceplate or anode plate coated with patterned phosphor. However, in order to allow free flow of electrons from the cathode plate to the phosphors and to prevent chemical contamination (e.g., oxidation of the electron emitters), the cathode plate and the anode plate are sealed within a vacuum.

It is important in FEDs that the particle emitting surface of the cathode plate and the opposed display face or anode plate be maintained insulated from one another at a relatively small, but uniform distance from one another throughout the full extent of the display face. Additionally, there is a relatively high voltage differential, e.g., generally above 200 volts, between the cathode emitting surface and the display face. It is important that electrical breakdown between the emitting surface and the display face be prevented. However, the space between the two plates has to be small to assure the desired thinness and that the high resolution is achieved. This spacing also has to be uniform for uniform resolution, uniform brightness, to avoid display distortion, etc. Nonuniformity in spacing can occur in FEDs since there typically is a high differential pressure on the opposed or exterior side of the display face, e.g., whereas the exposed side of the display face is at atmospheric pressure, a high vacuum of less than $10^{-6}$ torr, generally is applied between the cathode structure and the interior side of the display face.

In order to maintain the separation between the cathode plate and the anode plate (display face) across the dimensions of the FED in the pressure of the vacuum, structurally rigid spacers are positioned between the cathode plate and the anode plate. The design and manufacture of these spacers is one of the most difficult aspects in making FEDs. Without the spacers, the display face would deform due to the pressure of the vacuum, or worse yet collapse upon the cathode plate resulting in a voltage short between the cathode plate and the display face. Additionally, if the arrangement of the spacers is not properly registered, electrons emitted from the cathode array will be intercepted before striking a phosphor coated display face, materially affecting the brightness.

Disadvantageously, the spacers of the FED are visible to a viewer looking closely at the display. As such, there have been many attempts to design spacers in order to minimize their appearance. For example, spacers have been designed as walls or ribs (e.g., having an aspect ratio 50×1000 $\mu$m) extending between the cathode and anode plates or designed as other structures, such as balls, crosses and stars. However, this has proved an insurmountable task, e.g., as far as the inventors are aware, the spacers of all currently manufactured FEDs are visible upon inspection.

Traditionally, FEDs have been used as small, thin display devices, for example, display devices having 2–10 inch display screens and a total thickness of less than 10 mm, e.g., the thickness of the display face or the anode plate is typically about 1 mm. The largest known FEDs are approximately 10–12 inch displays. Many have attempted to develop FEDs as an alternative the liquid crystal displays (LCDs) for thin display devices, such as laptop or notebook computer displays; however, the larger the display device, the more difficult it is to maintain uniform separation between the cathode plate and the anode plate across the full dimensions of the display in the vacuum since the area of the cathode and anode plates has increased.

SUMMARY OF THE INVENTION

The invention provides improved structure of a field emission display (FED). In one embodiment, the invention provides an FED in which the thickness of the faceplate or display face is sufficient that the mechanical strength of the faceplate itself can withstand the pressure of the vacuum formed therein across the dimensions of the faceplate, thereby preventing deformation of the faceplate across its dimensions. Therefore, advantageously, spacers which are conventionally required to maintain a small and uniform spacing between a cathode and an anode of the FED are not required. By increasing the thickness of the faceplate, the overall thickness of the FED is substantially increased, such that the use of such FEDs is not be preferred in many traditional thin screen FED applications, such as many small, thin displays devices, such as personal digital assistant (PDA) displays or notebook computer displays. However, thicker FEDs in accordance with several embodiments of the invention could easily be applied in new applications for FEDs, such as computer monitor displays and television displays of all sizes. Additionally, FEDs may be implemented in larger display sizes than previously available.

Additionally, in another embodiment, an FED is provided which has an additional volume or an increased volume formed therein for the vacuum. This additional volume advantageously provides an improved volume to surface area ratio within the FED, which provides for a cleaner vacuum environment. That is, as molecules and other contaminants released within the FED vacuum during use, since there is more volume to surface area, it is less likely that such molecules may stick to a location of the FED that may lead to arcing that may damage the display. Furthermore, the larger volume provides for improved "gettering" or cleaning up of the vacuum. That is, since there is more volume, the region that a conventional getter (i.e., a material that absorbs contaminants within the vacuum) may be located is significantly increased. The larger getter region allows for more getter material to be used, which provides an improved and cleaner vacuum, which in turn improves the lifetime of the FED.

In one embodiment, the invention can be characterized as a field emission display comprising a faceplate; a backplate spaced apart from the faceplate; a volume formed in between the faceplate and the backplate, the volume maintained as a vacuum; a cathode having a cathode substrate and active cathode regions on the cathode substrate, at least a portion of the cathode substrate sealed within the volume; an anode including phosphor materials and sealed within the volume; and wherein a thickness of the faceplate and a thickness of the backplate are sufficient to prevent deformation of the faceplate and the backplate across the dimensions of the faceplate and the backplate due to the vacuum such that spacers are not needed within the volume in order to maintain a uniform separation between the anode and the active cathode regions in the vacuum.

In another embodiment, the invention can be characterized as a field emission display comprising a faceplate; a backplate spaced apart from the faceplate; a volume formed in between the faceplate and the backplate, the volume maintained as a vacuum; a cathode having a cathode substrate and active cathode regions on the cathode substrate, at least a portion of the cathode substrate sealed within the volume; and an anode including phosphor materials and sealed within the volume. The volume comprises a first portion in between the cathode substrate and the anode; and a second portion in between the cathode substrate and the backplate, the second portion continuous with the first portion.

BRIEF DESCRIPTION OF THE DRAWINGS

The above and other aspects, features and advantages of the present invention will be more apparent from the following more particular description thereof, presented in conjunction with the following drawings.

Corresponding reference characters indicate corresponding components throughout the several views of the drawings.

DETAILED DESCRIPTION

The following description is not to be taken in a limiting sense, but is made merely for the purpose of describing the general principles of the preferred embodiments. The scope of the invention should be determined with reference to the claims.

In accordance with several embodiments of the present invention, a field emission display (FED) is provided in which the thickness of the faceplate material is sufficient that the mechanical strength of the faceplate itself can withstand the pressure of the vacuum across the dimensions of the faceplate (also referred to as a display face or frontplate). Thus, deformation of the faceplate is prevented across the dimensions of the faceplate. Therefore, advantageously, spacers are not required. By increasing the thickness of the faceplate, the overall thickness of the FED is substantially increased, such that the use of such FEDs is not be preferred in many traditional thin screen FED applications, such as many small, thin displays devices, such as personal digital assistant (PDA) displays or notebook computer displays. However, thicker FEDs in accordance with several embodiments of the invention could easily be applied in new applications for FEDs, such as computer monitor displays and television displays of all sizes. In a preferred form, a thick glass FED is implemented as a large screen television, e.g., a 35 inch FED-based television is provided in which the faceplate and a corresponding backplate (or backplane) are each approximately 1 inch thick, i.e., about the same glass thickness as a conventional 35 inch cathode ray tube (CRT) television. Such a 35 inch FED-based television may have an overall thickness of approximately 6–8 inches, the FED itself being about 4 inches thick. In contrast, known FEDs have a faceplate that is typically no more than 1 mm thick while the entire display has a thickness of about 10 mm or less. Again, although a thick glass FED according to several embodiments of the invention is too thick for conventional thin screen (e.g., 10 mm thick or less) FED type applications, it is more than ideal for large screen displays or other small screen applications that do not require a display as thin as conventional FEDs. Such FED-based televisions would be comparable in thickness to other liquid crystal display (LCD) and plasma display televisions, although potentially less expensive and difficult to manufacture.

Figure 1:
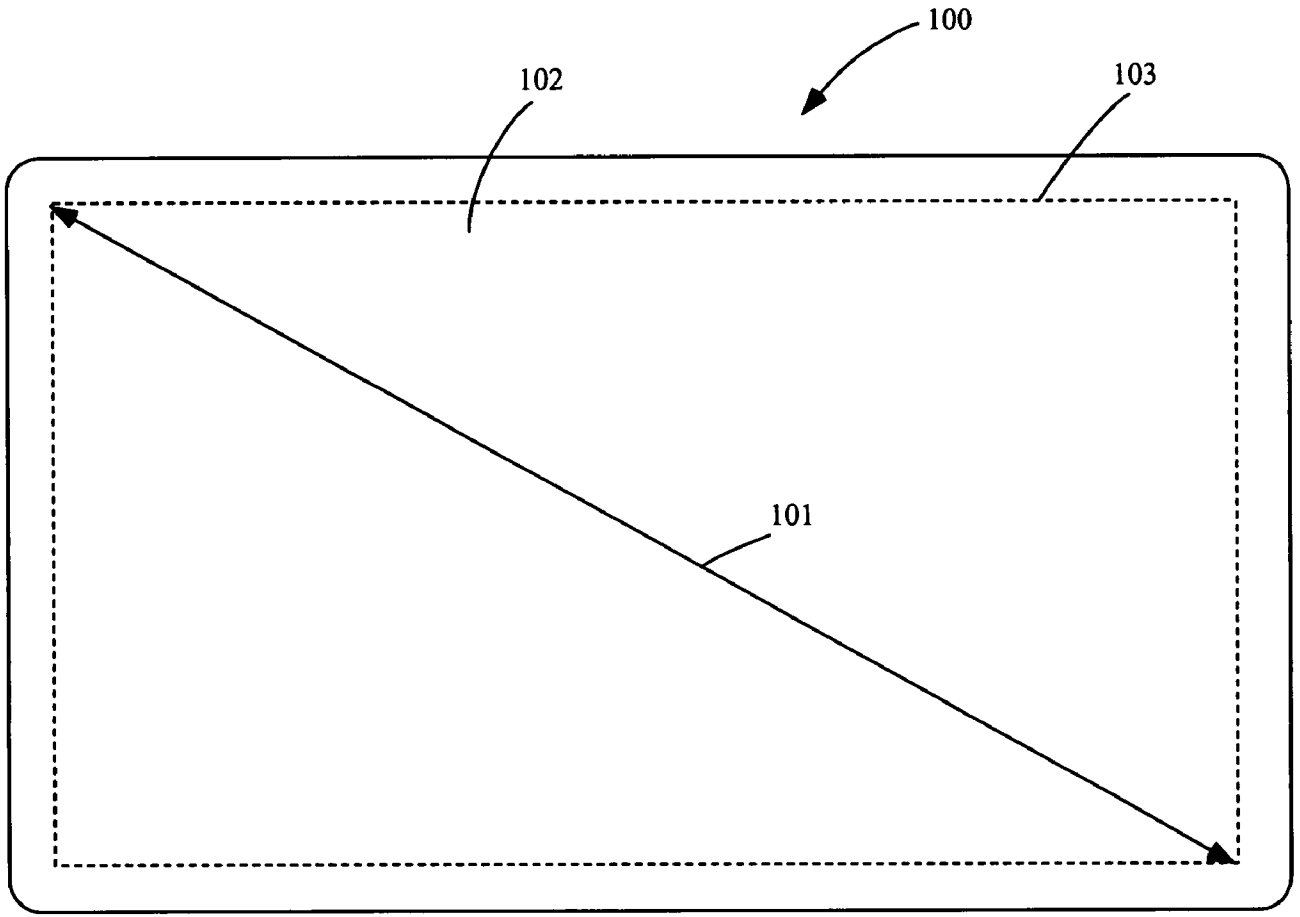
FIG. 1 is a plan view of a faceplate of a spacer-less field emission display (FED) in accordance with one embodiment of the invention.
Figure 2:
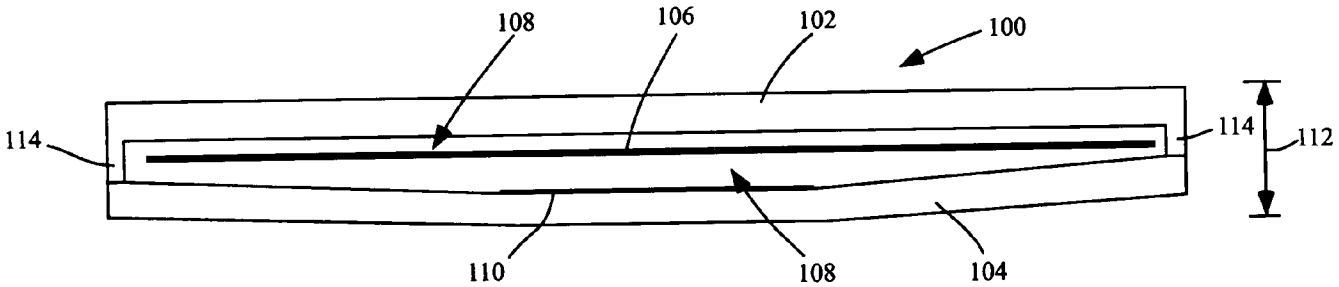
FIG. 2 is a side cutaway schematic diagram of one embodiment of the FED of FIG. 1 illustrating the faceplate, a backplate and a cathode.

Referring first to FIGS. 1 and 2, a field emission display 100 (hereinafter referred to as FED 100) is provided in accordance with several embodiments of the invention. According to many embodiments, the faceplate 102 (also referred to as the frontplate or display face) and the backplate 104 (also referred to as the backplane) of FED 100 have a thickness sufficient that the mechanical strength of the faceplate 102 and backplate 104 can withstand the pressure of the vacuum within the FED 100 without sagging across the entire dimensions of the faceplate and without the use of spacers. Thus, advantageously, spacers are not required and thus, not used at all in the FED 100. The faceplate 102 and the backplate 104 are sealed together using a sealant (e.g., frit) and define a volume 108 therein.

As illustrated, the faceplate 102 includes a ridge portion 114 or lip portion extending substantially normal to the plane of the faceplate 102 at its periphery that couples to the backplate 104. This ridge portion 114 creates a spacing or separation between the faceplate 102 and the backplate 104 thereby defining the volume 108. An FED cathode 106 is held within the volume, e.g., using a support structure (shown, for example, in FIG. 4) within the volume 108, such that an emitting surface of the cathode 106 is proximate to and coplanar with an FED anode (not shown in FIGS. 1 and 2) formed on an interior surface of the faceplate 102. A vacuum is formed within the volume 108. In this embodiment, the cathode 106 does not fully extend to the interior edges of the sides of the faceplate, such that the volume 108 includes a portion between the cathode 106 and the anode (formed on the interior of the faceplate 102) and a portion between the cathode 106 and the backplate 104.

The size 101 of the FED 100 is defined as the distance from one corner of the viewing area 103 of the faceplate 102 to a diagonal opposite corner of the viewing area 103 of the faceplate 102, i.e., the viewable area of the faceplate 102 defines the size 101 of the FED 100. According to preferred embodiments, the size 101 of the faceplate 102 is approximately 35 inches, i.e., the FED 100 is a 35-inch display. It is noted that depending on the display, the faceplate 102 having a given size 101 may have an aspect ratio of 16:9 (widescreen format) or 4:3 or other depending on the implementation of the FED 100. The faceplate 102 and the backplate 104 are preferably made of glass and are each approximately 10–30 mm thick, preferably about 20 mm thick.

Although the FED 100 is illustrated having preferred dimensions, the dimensions of the faceplate 102 and the backplate 104 could be varied depending on the implementation. However, regardless of the exact dimensions of the faceplate 102 and the backplate 104, it is important in many embodiments, that the thickness of the faceplate and the backplate be such that the material of the faceplate and the backplate provides enough mechanical strength to maintain a small (e.g., 2 mm or less) and substantially uniform separation between the cathode 106 and anode of the FED 100 throughout the dimensions of the viewable area 103. The exact thickness required will depend on the material(s) used in the construction of the faceplate 102 and the backplate 104. In preferred embodiments, the maximum corner stress of a glass faceplate and a glass backplate should be 1.0 $kgf/mm^2$ and the maximum frit (sealant) stress should be 0.7 $kgf/mm^2$, such that the glass plates of a 35-inch display should be at least 10 mm thick. It is also preferable that the glass not be too thick since this adds to the weight of the FED. Additionally, the glass should not be so thick that it sags under its own weight. For example, the glass plates of the 35-inch display should each be between about 10 and 30 mm thick. Although, in preferred embodiments, the faceplate 102 and the backplate 104 are made of a glass material, other materials may be used without departing from the invention.

Furthermore, it is noted that the thickness of the ridge portion 114 is not required to be as thick as the faceplate 102 or the backplate 104 since it is not as important that the distance across the width of the FED be maintained uniform, rather the distance between the anode and the cathode be uniformly maintained.

Advantageously, the thicker structure of the faceplate 102 and the backplate 104 allow for FEDs to be made that have screen sizes larger than known conventional FEDs. For example, the largest known conventional FEDs are about 10–12 inch displays. In contrast, a spacer-less FED according to several embodiments of the invention may be made larger than 10–12 inches, e.g., up to 35–40 inches, without the use of spacers.

Furthermore, at least the viewing area 103 of the faceplate 102 should allow light to transmit therethrough in order to create a viewable display. However, it is not necessary that the entire faceplate 102 and/or the backplate 104 be similarly transmissive.

Additionally, according to several embodiments, the volume 108 within the FED 100 is much larger than in conventional FEDs. As mentioned above, the volume 108 defined within the FED 100 includes a portion in between the emitting surface of the cathode 106 and the interior surface of the faceplate 102 (i.e., on which surface the anode is formed). Additionally, since the cathode 106 has been moved off of the backplate 104, in contrast to conventional FEDs, the volume 108 of FED 100 also includes from a bottom surface (non-emitting or inactive surface) of the cathode 106 to an interior surface of the backplate 104. In order that the two portions are continuous, the cathode substrate does not extend across the full width of the faceplate 102. Traditional FEDs do not have a volume formed on a back side of the cathode, i.e., the cathode of a conventional FED is positioned directly on a conventional backplate. Or alternatively, the substrate (e.g., a ceramic substrate) of the cathode is made thick enough to also function as the backplate without requiring a separate backplate. As illustrated, the portion of the volume 108 between the cathode and the backplate 104 is larger than the portion of the volume 108 between the faceplate 102 and the cathode 106.

A problem encountered in conventional FEDs is that they exhibit a low ratio of volume to surface area. That is, the volume of the vacuum within the conventional FED is not large relative to the surface area of surfaces within the vacuum. During use, molecules, atoms, and other contaminants such as water, carbon dioxide, etc., may come free into the volume and stick to surfaces within the FED. Unfortunately, some of these molecules may stick to the electron emitting surfaces of the cathode. In use, the molecules may then ionize and causing arcing, which may damage the display device.

On the other hand, the increased volume 108 does not necessarily mean that the cathode 106 and the anode are made any thicker. Thus, the ratio of the volume to the surface area of the materials within the volume 108 (such as, the interior surfaces of the faceplate 102 and the backplate 104, the cathode 106 surfaces, support structure for holding the cathode 106, etc.) is increased. The increased ratio of volume to surface area provides for a cleaner vacuum environment. That is, as molecules are released, since there is more volume, it is less likely that such molecules may stick to a location (e.g., an active cathode or anode region) that may lead to arcing that may damage the display.

Additionally, the larger volume 108 provides for improved "gettering" or cleaning up of the vacuum. Typically, a material known as a getter is located within a conventional FED. The conventional getter is typically barium or other suitable material sprayed or deposited on to a non-emitting surface or non-active surface within the volume which absorbs contaminants from within the volume. Known FEDs typically locate the getter material at a periphery region of the cathode substrate away from the cathode emitting surface and away from the phosphors of the anode. Care is taken to ensure that none of the getter is positioned or otherwise coats the emitting surface and/or the phosphors of the anode. Thus, there is very little volume within known FEDs for the getter material to be located.

According to several embodiments of the invention, and as illustrated in FIG. 2, the preferred getter 110 is deposited within the portion of the volume 108 between the non-emitting surface of the cathode 106 and the backplate 104. This provides for a significantly larger getter region than previously obtainable in known FEDs. The larger getter region allows for more getter material to be used which provides an improved and cleaner vacuum which improves lifetime of the FED 100. As illustrated in FIG. 2, the getter 110 is deposited on an interior region of the backplate 104. Thus, the getter region is spatially separated from the active area of the FED 100. Together, the increased ratio of volume to surface area together with the increased getter 110 region lead to a cleaner vacuum and thus, improved or extended lifetime of the FED 100.

It is noted that in some embodiments, the getter 110 may be located anywhere within the volume other than the anode and the active area of the cathode; however, according to preferred embodiments, the getter 110 is located within the portion of the volume 108 between the cathode 106 and the back plane 104.

According to one embodiment, the backplate 104 of FIG. 2 is illustrated as beveling outward at a slight angle from the edges toward the center of the backplate 104. This adds to the mechanical strength of the backplate 104, such that the backplate made be made slightly thinner than if the backplate 104 were completely flat. It is noted that the backplate may alternatively be completely flat (see, for example, FIGS. 3A and 3B) without departing from several embodiments of the invention.

Figure 3A:
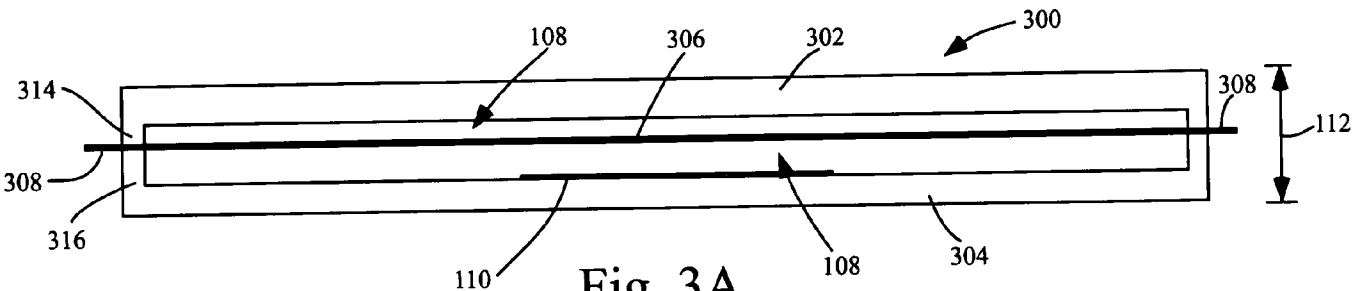
FIG. 3A is a side cutaway schematic diagram of another embodiment of the FED of FIG. 1 illustrating the faceplate, the backplate and a cathode that is sandwiched between the faceplate and the backplate.

Referring next to FIG. 3A, an alternative embodiment of the FED of FIG. 1 is shown. In this embodiment, the faceplate 302 and the backplate 304 of the FED 300 sandwich the cathode 306 such that a periphery portion 308 of the substrate of the cathode 306 extends outside of the volume 108 and outside of the exterior edges of the faceplate 302 and the backplate 304. That is, the non-active portion of the cathode extends outside of the volume 108 while the active portions (i.e., the emitting surface) of the cathode 306 are sealed within the volume 108 in a vacuum. Thus, the substrate of the cathode 306 separates the faceplate 302 from the backplate 304. In this embodiment, the faceplate 302 includes a ridge portion 314 extending substantially normal to the plane of the faceplate 302 at its periphery and the backplate 304 also includes a ridge portion 316 extending substantially normal to the plane of the backplate 304 at its periphery. The two ridge portions 314 and 316 sandwich the cathode 306 therebetween to create a spacing or separation of the faceplate 302 and the cathode 306 and a spacing between the cathode 306 and the backplate 304; thus, creating a spacing or separation between the faceplate 302 and the backplate 304 thereby defining the volume 108. A sealant, e.g., frit, is used to seal the substrate of the cathode 306 between the ridge portion 314 of the faceplate 302 and the ridge portion 316 of the backplate 304. Preferably, ridge portion 316 extends longer than ridge portion 314 such that the portion of the volume 108 between the cathode 306 and the backplate 304 is larger than the portion between the cathode 306 and the faceplate 302.

In preferred embodiments, in order that the volume 108 within the FED 300 is continuous (i.e., in order that the portion of the volume 108 in between the emitting surface of the cathode 306 and the interior surface of the faceplate 302 is continuous with the portion of the volume 108 in between the non-emitting surface of the cathode 306 and the backplate 304), the entire periphery of the cathode substrate does not extend outside of the volume 108. For example, the substrate may extend outside of the volume at two opposite edges, while the adjacent two opposite edges do not extend the full width of the interior volume (similar to the cathode 106 of FIG. 1). Thus, in preferred embodiments, less than the entire periphery of the substrate extends outside of the volume 108, i.e., the periphery portion 308 does not continuously extend about the entire FED 100. Additional sealant or substrate material may be positioned at the junction of the ridge portions 314 and 316 to account for the portions of the substrate that do not extend outside of the volume through the faceplate 302 and the backplate 304.

Figure 3B:
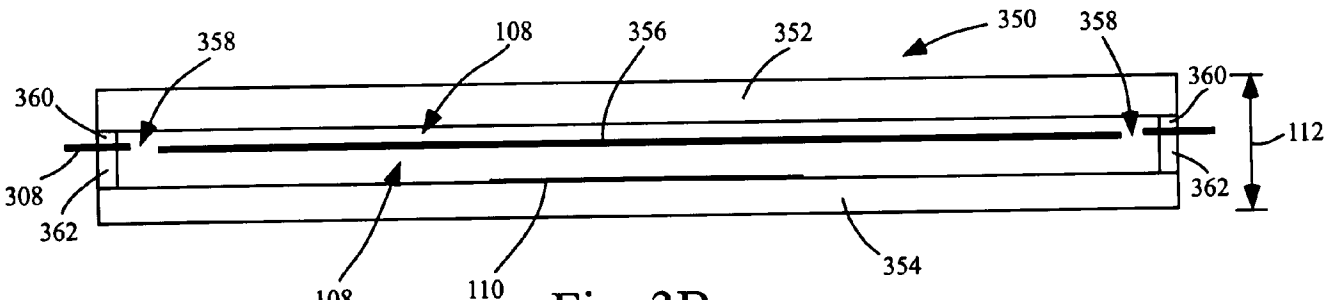
FIG. 3B is a cutaway view of a variation of the FED of FIG. 3A illustrating perforations in the cathode substrate and frame supports for separating the faceplate and the backplate.

As illustrated in FIG. 3B, in a variation of the FED 300 of FIG. 3A, FED 350 of FIG. 3B, the substrate of the cathode 356 extends outside of the volume 108 through the sides of the faceplate 352 and the backplate 354 about its entire periphery, i.e., periphery portion 308 extends continuously around the entire FED 350. However, in order to provide a continuous volume 108 within the FED 350, holes 358 or perforations are drilled or otherwise formed or provided within the substrate proximate to the interior edges of the faceplate 352 and backplate 354 sides. The holes 358 connect the portion of the volume 108 between the cathode 356 and the faceplate 352 and the portion between the cathode 356 and the backplate 354.

Furthermore, in the embodiment of FIG. 3B, the faceplate 352 and the backplate 354 are flat plates that do not have ridge portions formed at their outer edges. In order to provide a separation between the faceplate 352 and the backplate 354 (and between the cathode 356 and the faceplate 352), frame supports 360 and 362 are provided. Frame support 360 is a separate structure, preferably made of the same material as the faceplate, e.g., glass, which extends about the outer perimeter of the faceplate 352 and which functions similarly to ridge portions 114 and 314. Frame support 362 is a separate structure, preferably made of the same material as the faceplate, e.g., glass, which extends about the outer perimeter of the backplate 354 and which functions similarly to ridge portion 316. It is noted that frame support 362 is longer than frame support 360 such that the portion of the volume 108 between the cathode 356 and the backplate 354 is larger than the portion between the cathode 356 and the faceplate 352. However, it is understood that the dimensions of frame supports 360 and 362 may be varied without departing from several embodiments of the invention. An appropriate sealant, e.g., frit, is used to adhere and seal the frame supports 360 and 362 to the respective surfaces of the faceplate 352, the backplate 354 and the portion of the cathode substrate extending outward. Furthermore, it is understood that one or more of the embodiments described herein may include frame supports instead of or in addition to ridge portions of the faceplate and/or the backplate.

Advantageously, in the embodiments of FIGS. 3A and 3B, the lead lines for the active portions of the cathodes 306, 356 are extended on the substrate outside of the volume 108 to allow for easy electrical connection to a cathode driving source. However, a connector (not shown in FIGS. 3A and 3B) for the anode high voltage is provided in the faceplates 302, 352 (or frame support 360) for electrical connection to the anode of the FEDs 300, 350.

The preferred dimensions of FED 300 are similar to those of the FED 100 of FIG. 2. For example, the thickness of a glass faceplate 302 and a glass backplate 304 of a 35-inch FED based television should be at least about 10 mm thick, e.g., about 1 inch thick, such that the overall display thickness is about 4 inches. Again, although this is much thicker than conventional FEDs, which may be as much as 10 mm thick total, in larger display implementations, such as computer monitors and televisions, in particular, large screen televisions (e.g., televisions greater than 20 inches), such overall thickness is still considered thin. Even at 4 inches thick, such an FED is comparable to existing large screen LCD and large screen plasma display devices. Again, it is understood that the dimensions of the components of the FEDs 300 and 350 may be varied according to the implementation and materials used without departing from several embodiments of the invention. Furthermore, it is noted that the thickness of the frame supports 360 and 362 are not required to be as thick as the faceplates 302, 352 or the backplates 304, 354 since it is not as important that the distance across the width of the FED be maintained uniform.

It is noted that the embodiments of FIGS. 3A and 3B share the same advantages and features as the FED 100 of FIG. 2. For example, the thickness of the faceplate and the backplate are designed such that the structural strength of the material itself (glass) will support the faceplate and backplate, and thus, maintain uniform separation between the cathode 306 and anode across the dimensions of the FED without the use of spacers. Additionally, FEDs 300 and 350 also provide a much larger volume containing the cathode 306 and anode for the vacuum, which decreases the likelihood that particles within the vacuum may stick to locations of the cathodes 306, 356 that may cause arcing and damage the FED. A large getter 110 is positioned within the larger volume, e.g., within the portion of the volume 108 between the cathode and the backplate. As such, the volume to surface area ratio is significantly increased, which allows for improved gettering, and thus improved vacuum and longer display lifetime.

With respect to the FEDs described herein, it is desirable that the material selected for the faceplates, backplates, frame supports 360, 362, and sealant be selected such that they exhibit a similar coefficient of thermal expansion. As such, the vacuum may be maintained across a broad range of temperatures.

Figure 4:
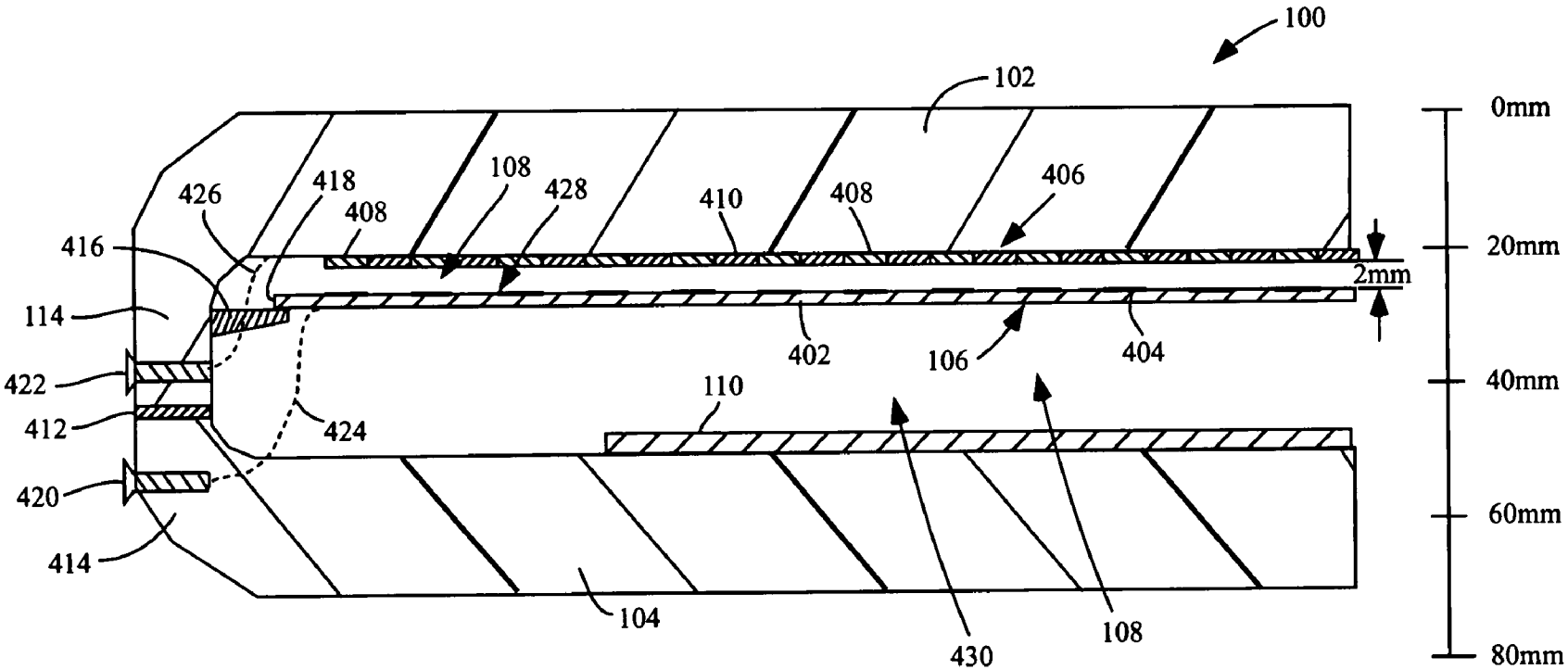
FIG. 4 is a partial side cross sectional view of one embodiment of the FED of FIG. 2 illustrating the arrangement of the cathode and an anode.

Referring next to FIG. 4, a partial side cross sectional view is shown illustrating in more detail the FED of FIG. 2. The FED 100 includes the faceplate 102 and the backplate 104 having the cathode 106 sealed within the volume 108 formed between the faceplate 102 and the backplate 104. The cathode 106 includes a substrate 402 (e.g., a ceramic substrate) including active regions 404 (e.g., cathode sub-pixel regions) formed on the substrate 402. An anode 406 is formed on an interior surface of the faceplate 102 and the cathode is oriented such that the active regions 404 (on the top surface) of the cathode 106 face phosphors 408 of the anode 406. As is well known, the anode 406 includes a matrix of phosphors 408 (e.g., red, blue and green phosphors) and black material 410, the phosphors 408 each correspond to a cathode sub-pixel portion, e.g., an active region 404.

In the embodiment illustrated, the faceplate 102 is generally formed as a flat glass plate with the ridge portion 114 that extends about its periphery substantially normal to the plane of the flat plate. Likewise, the backplate 104 is generally formed as a flat glass plate with a ridge portion 414 that extends about its periphery substantially normal to the plane of the backplate 104. The two ridge portions 114 and 414 meet about the entire periphery thereof and are sealed together using the appropriate sealant 412, e.g., frit. Thus, as illustrated, a volume 108 is formed between the interior surfaces of the faceplate 102 and the backplate 104.

Within the volume 108, a support structure 416 is rigidly fixed to an interior surface of the ridge portion 114 of the faceplate 102. The support structure 416 acts as a ledge or lip upon which the substrate 402 of the cathode rests. Alternatively, the support structure 416 may be implemented as a clamp or other structure to hold the substrate 402. In preferred form, there are several support structures 416 each rigidly fixed (e.g., adhered with frit) at various locations about the interior periphery of the ridge portion 114 of the faceplate 102. The substrate 402 is positioned such that at least a portion of the periphery of the substrate 402 rests on the supports structures 416 and the substrate 402 is held to be coplanar with the anode 406 and the faceplate 102. The outer periphery edge 418 of the substrate 402 preferably does not extend completely flush with the interior surface of the ridge portion 114 so that the portion 428 of the volume 108 between the anode 406 and the cathode 106 and the portion 430 of the volume 108 between the cathode 106 and the backplate 104 are continuous. The substrate 402 is fixed to the support structure(s) 416, e.g., using an appropriate glue or frit, such that it will be rigidly held in position.

Additionally, a cathode connector 420 and an anode connector 422 are inserted through respective holes in the faceplate 102 and the backplate 104. For example, in preferred embodiments, a hole is drilled or otherwise formed in the ridge portion 114 of the faceplate 102 for the anode connector 422. Similarly, a hole is drilled or otherwise formed in the ridge portion 414 of the backplate 104 for the cathode connector 420. The anode connector 422 allows for electrical connection of a high voltage source to the anode 406 via electrical wires 426. The cathode connector 420 allows for electrical connection of a cathode driving source to the cathode 106 via electrical wires 424. As is well known in the art, the cathode 106 requires that a voltage potential be applied to base electrodes and gate electrodes of the cathode 106.

As illustrated, the volume 108 within the FED 100 includes a front portion 428 between the anode 406 and the cathode 106, such as found in conventional FEDs, but additionally includes a rear portion 430 in between a bottom surface of the cathode substrate 402 and the interior surfaces of the backplate 104. The additional rear portion 430 of the volume 108 is a departure from known FEDs. That is, in conventional FEDs, the cathode substrate is positioned directly on the backplate. In contrast, according to several embodiments of the invention, the additional portion 430 is also formed, while at the same, the surface area of the cathode 106 and anode 406 remains the same. This provides for a higher volume to surface area ratio in comparison to conventional FEDs. In preferred form, the portion 430 is larger than portion 428. For example, the volume of portion 430 is at least 2 times greater, more preferably, at least 5 times greater, and most preferably, at least 10 times greater than the volume of portion 428. Advantageously, as described above, this increased volume provides a larger overall volume 108 within which molecules and other contaminants may be released and the same active cathode surface area for which these contaminants may land. Thus, the likelihood that a particular particle will land on an active region 404 of the cathode or phosphors 408 of the anode and cause arcing is reduced.

Furthermore, as described above, a significantly larger region for a getter 110 material is provided. In a conventional FED, the getter is typically located at the periphery of the cathode substrate separated from the active cathode regions of the cathode. This provides a relatively small area for the getter. However, since the additional portion 430 of the volume 108 is provided, the getter 110 is preferably located within this additional volume 430. Therefore, the amount of getter material may be increased by at least 10 times, preferably by at least 100 times and most preferably by at least 1000 times, in comparison to the amount of getter that could be used on a similarly sized conventional FED. Again, the increased getter material provides for improved gettering, and thus, a cleaner vacuum, which will result in a longer FED lifetime. It is noted that the getter 110 in preferred embodiments, is located (e.g., sprayed or otherwise deposited) about an interior surface of the backplate 104. Although, it is understood that the getter 110 may be positioned within other locations of the portion 430, such as on the interior surface of one or more of the ridge portions 114 and 414. In other embodiments, the getter 110 may also be located within the portion 428, e.g., on an interior surface of the ridge portion 114 or on the support structure(s) 416.

The relative thickness of the various components of the FED 100 is also illustrated in FIG. 4 in according to one embodiment of the invention. As seen, the faceplate 102 and the backplate 104 are each about 20 mm thick. Again, by sizing the faceplate 102 and the backplate 104 to be about 10–30 mm thick for an FED having approximately 35-inch faceplate 102, the mechanical strength of the faceplate 102 and the backplate 104 are sufficient to withstand the pressure of the vacuum across the dimensions of the face plate 102 without sagging or other non-uniformities. Therefore, advantageously, spacers to maintain a uniform distance between the anode 406 and the cathode 106 are not required. Furthermore, it is noted that the distance between a top surface of the cathode 106 and a bottom surface of the anode 406 is preferably approximately 2 mm, which for clarity purposes is not illustrated to scale. Additionally, the overall thickness of the FED 100 from the faceplate 102 to the backplate 104 is approximately 70 mm, which is exceptional, particularly for a large screen television. It is noted that the depending on the thickness of the various components, the FED 100 for a 35-inch television display using conventional glass may be about 50–100 mm depending on the size of the portion 430 of the volume. It is noted that such dimensions may be altered depending on the overall display size and the type and strength of the particular materials used for the faceplate 102 and the backplate 104. Again, in contrast to known FEDs, an FED display having a display greater than 10–12 inches is possible in accordance with several embodiments of the invention.

Figure 6:
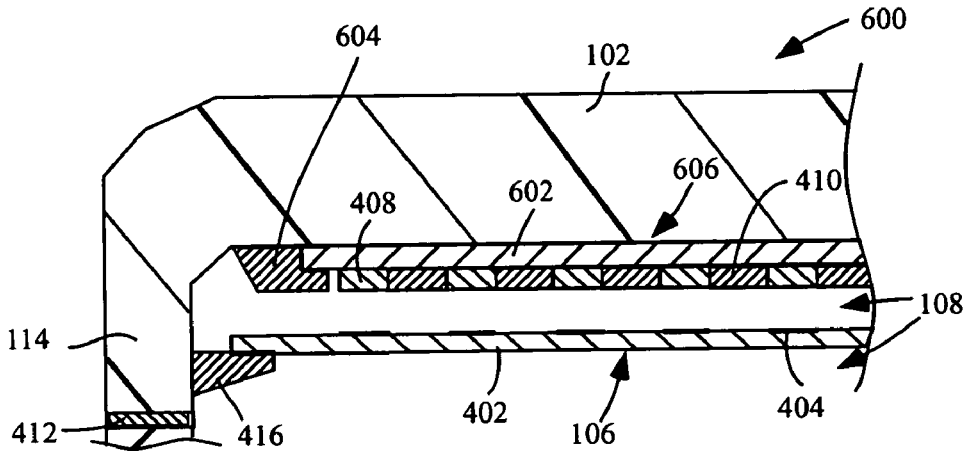
FIG. 6 is a partial cross sectional view of a variation of the FED of FIGS. 2 and 4 in which the anode is formed on a separate anode plate held within the FED volume.
Figure 7:
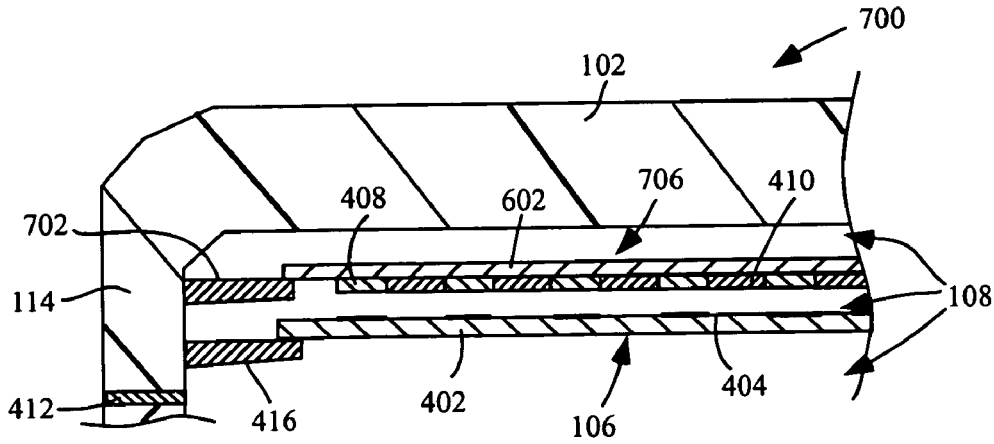
FIG. 7 is a partial cross sectional view of another variation of the FED of FIGS. 3A and 5A in which the anode is formed on the separate anode plate held within the FED volume.

Although the anode 406 is illustrated as being formed on an interior surface of the faceplate 102, in other embodiments, the anode may be formed on a separate glass (or other suitable material) plate that is held within the volume 108 similarly to the cathode 106. For example, another set of support structures are rigidly attached about the inner periphery of the ridge portion 114 to hold an anode plate a fixed distance above and coplanar to the cathode 106. Alternatively, such support structures may be in the form of clip members that are affixed to the periphery interior surfaces of the faceplate 102 in order to hold such an anode plate against the faceplate 102. A few such alternative embodiments is illustrated in FIGS. 6–7.

In another alternative embodiment, such as described below in FIG. 8, the cathode 106 rests upon the backplate 104, while the thickness of the faceplate 102 and the backplate 104 are designed such that spacers are not required. In this embodiment, the volume 108 does not include the additional portion 430 and thus, does not have the additional advantages in improved volume to surface area and improved gettering as in preferred embodiments.

In another alternative embodiment, the additional portion 430 is provided for an improved ratio of volume to surface area in an FED, and improved gettering, without necessarily having the faceplate and the backplate with a thickness sufficient to avoid the use of spacers. For example, in such alternative embodiment, the faceplate thickness is considerably thinner (e.g., a conventional faceplate thickness) such that spacers are required between the anode 406 and the cathode 106 in order to maintain a uniform separation between the anode 406 and the cathode 106. However, these embodiments do benefit from the improved ratio of volume to surface area and improved gettering.

It is noted that the manufacture and operation of the cathode 106 and the anode 406 is well known in the art. For example, a typical cathode construction includes conductive base electrodes printed on the cathode substrate, a layer of dielectric material formed over the substrate and the base electrodes, a conductive gate electrode layer formed over the dielectric layer and etched into gate electrodes, a matrix of wells etched in the gate electrodes and the dielectric layer, and an electron emitter deposited within each well on a respective base electrode. A voltage potential is applied to respective base electrodes and respective gate electrodes in order to emit electrons from respective ones of the emitters within the wells (e.g., forming the active regions 404 of the cathode). A corresponding anode includes a matrix of phosphor materials (e.g., red, blue and green phosphors 408). In order to accelerate the emitted electrons toward respective phosphors of the anode, a high voltage potential is applied to respective portions of the anode. Furthermore, operation of an FED is additionally well known. Driving/addressing software is coupled to the FED in order to create the appropriate electrical signals to the cathode and the anode of the FED in order to render the desired image.

It is noted that although conventional cathode and anode structures may be used within the FEDs described herein, alternative FED cathode and anode designs may be implemented. For example, cathodes, such as described in U.S. patent application Ser. No. 10/305,527, filed herewith, of Russ, et al., entitled FIELD EMISSION DISPLAY USING LINE CATHODE STRUCTURE, and U.S. patent application Ser. No. 10/305,559, filed herewith, of Russ, et al., entitled FIELD EMISSION CATHODE STRUCTURE USING PERFORATED GATE, which are incorporated herein by reference, may be used within the FEDs described herein.

Figure 5A:
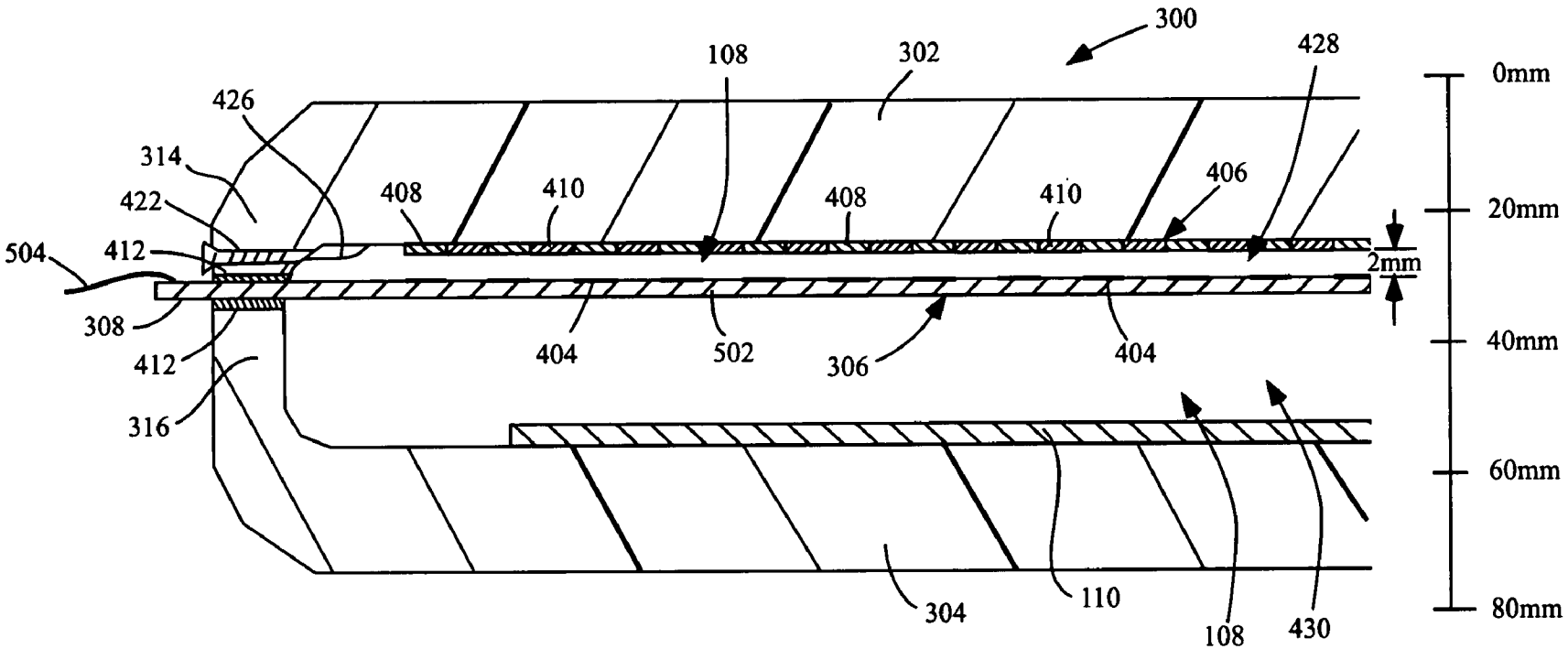
FIG. 5A is a partial side cross sectional view of one embodiment of the FED of FIG. 3A illustrating the arrangement of the cathode and an anode with a portion of the cathode extending outside of the volume of the FED.

FIG. 5A is a partial side cross sectional view illustrating in more detail the FED of FIG. 3A. The FED 300 of FIG. 5A is similar to the FED 100 of FIG. 4; however, at least a portion of the cathode substrate 502 extends out of the volume 108 formed within the faceplate 302 and the backplate 304. As illustrated, the periphery portion 308 of the substrate 502 extends out of the volume 108. That is, a non-active edge portion of the cathode 306 extends outside of the volume 108 while the active regions 404 (i.e., the emitting surfaces) of the cathode 306 are sealed within the volume 108 in a vacuum. Advantageously, in this embodiment, the lead lines for the active portions 404 of the cathode 306 (i.e., for the base and gate electrodes) are extended on the substrate outside of the volume 108 to allow for easy electrical connection to a cathode driving source via electrical leads or wires 504.

In this embodiment, the periphery portion 308 of the substrate 502 of the cathode 306 separates the faceplate 302 from the backplate 304. A sealant 412, e.g., frit, is used to seal the substrate of the cathode 306 between the faceplate 302 and the backplate 304. Thus, a layer of sealant 412 is between the end of the ridge portion 314 and the substrate 502 and between the substrate 502 and the end of the ridge portion 316. As described above, the ridge portions 314 and 316 provide the appropriate separation between the faceplate 302 and the backplate 304 to define the volume 108 and between the anode 406 and the cathode 306. Additionally, since the substrate 502 should be held a very small distance from the anode 406, e.g., about 2 mm from the top of the cathode 306 to the anode 406, the ridge portion 314 is shorter relative to the ridge portion 114 of the FED illustrated in FIG. 4. However, the ridge portion 316 is taller than the ridge portion 314 in order that volume portion 430 is larger than volume portion 428. It is noted that one or more frame supports, such as described in FIGS. 3B and 5B, may replace the ridge portions 114, 314 and 316.

It is noted that an anode connector 422 is provided through a hole in either the ridge portion 314 of the faceplate 302 or other portion of the faceplate (e.g., the corner of the faceplate and the ridge portion 314) . The anode connector 422 provides the electrical wires 426 to provide a high voltage signal to the anode 406.

It is further noted that in this embodiment, it is preferred that the entire periphery of the substrate 502 does not extend out from the volume such that portion 428 of the volume 108 and portion 430 of the volume 108 remain continuous. For example, only a portion of each side of the substrate 502 extends out of the volume 108. Alternatively, as described above, the additional portion 430 may be removed, such that the backplate 304 is flush against the substrate 502; however, the getter 110 will have to be located within the portion 428 of the volume 108. In this alternative embodiment, the backplate 304 is typically a straight flat plate without a ridge portion.

Figure 5B:
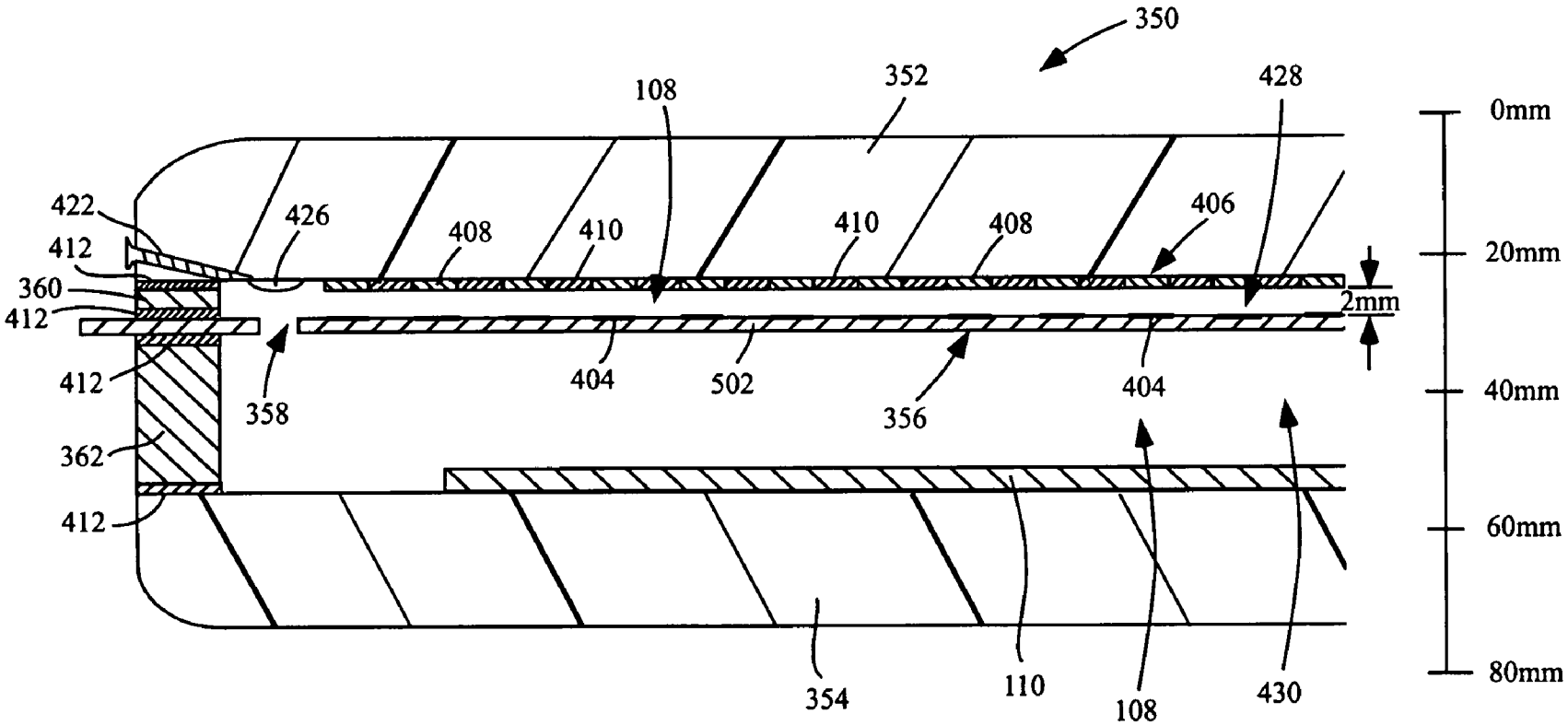
FIG. 5B is partial cross sectional view of one embodiment of the FED of FIG. 3B.

FIG. 5B is a partial cross sectional view of a variation of the FED of FIGS. 3A and 5A. The FED 350 of FIG. 5B is similar to the FED 300 of FIG. 5A; however, the entire periphery of the substrate 502 of the cathode 352 extends outside of the volume 108 formed by the faceplate 352 and the backplate 354. In order that the portions 428 and 430 of volume 108 are continuous, holes 358 or perforations are formed within the substrate 502 proximate to the interior edges of the faceplate 352 and backplate 354 sides. The holes 358 connect the portions 428, 430 of the volume 108 between the cathode 356 and the faceplate 352 and between the cathode 356 and the backplate 354.

Furthermore, as illustrated FIG. 5B, the faceplate 352 and the backplate 354 are flat plates that do not have ridge portions formed at their outer edges. However, in order to provide a separation between the faceplate 352 and the backplate 354 (and between the cathode 356 and the faceplate 352), frame supports 360 and 362 are provided. As described above, frame support 360 is a separate structure, preferably made of the same material as the faceplate, e.g., glass, which functions similarly to ridge portions 114 and 314. Frame support 362 is a separate structure, preferably made of the same material as the faceplate, e.g., glass, which functions similarly to ridge portion 316. It is noted that frame support 362 is preferably longer than frame support 360 such that the portion of the volume 108 between the cathode 356 and the backplate 354 is larger than the portion between the cathode 356 and the faceplate 352. However, it is understood that the dimensions of frame supports 360 and 362 may be varied without departing from several embodiments of the invention. An appropriate sealant 412, e.g., frit, is used to adhere and seal the frame supports 360 and 362 to the respective surfaces of the faceplate 352, the backplate 354 and the portion of the cathode substrate extending outward. Furthermore, it is understood that one or more of the embodiments described herein may include frame supports instead of or in addition to ridge portions of the faceplate and/or the backplate.

Additionally, the anode connector 422 is shown as extending through a side or corner portion of the faceplate 352 to provide the electrical wires 426 to the anode 406. However, in other variations, the anode connector 422 may be formed through one of the frame structures 360 and 362 or through the backplate 354.

Referring next to FIG. 6, a partial cross sectional view is shown of an alternative embodiment in which the anode is formed on a separate anode plate within the volume of the FED. In this embodiment, the FED 600 is similar to the FED 100 of FIGS. 2 and 4, i.e., the cathode 106 is entirely contained within the volume 108. Rather than forming the anode on an interior surface of the faceplate 102, the anode 606 is formed on a separate anode plate 602 upon which a conductive anode electrode layer (not shown) and the phosphors 408 and black material 410 are formed. The anode plate 602 is held against the interior surface of the faceplate 102 by one or more clip members 604 affixed to the interior surface of the faceplate 102. The clip members 604 may generically be referred to as an anode support structure. The cathode 106 is held in position a uniform distance from and coplanar with the anode 606 by support structures 416 as described above.

Referring next to FIG. 7, another alternative embodiment is shown in which the anode is formed on a separate anode plate within the volume of the FED. The anode 706 of the FED 700 of this embodiment is the separate anode plate 602 upon which a conductive anode electrode layer (not shown) and the phosphors 408 and black material 410 is formed. The anode plate 602 is fixedly held a distance from the interior surface of the faceplate 102 and fixedly held a uniform distance from and coplanar with the cathode 106 by one or more support structures 702 (e.g., ledges, lips, clamps, etc.) affixed to and extending from the interior surface of the ridge portion 114 of the faceplate 102. Similarly, the cathode 106 is held in position a uniform distance from and coplanar with the anode 706 by one or more support structures 416 as described above.

Advantageously, by forming the anode on a plate separate from the faceplate 102, the faceplate 102 and the anode plate 602 of FIGS. 6–7 may be separately manufactured. This provides for easier manufacturing, especially where the faceplate 102 includes a ridge portion 114 about its periphery edges.

Although the anodes 606 and 706 of FIGS. 6 and 7 are illustrated in the context of the FED of FIGS. 2 and 4, a similar separate plate anode may be implemented in the FED of FIGS. 3A–3B and 5A–5B in which at least a portion of the cathode substrate extends outside of the volume 108, as well as other non-illustrated embodiments. Furthermore, it is noted that the anode and cathode electrical connectors and wires are not illustrated in FIGS. 6 and 7; however, such embodiments certainly include such connections or other means to provide the appropriate potentials to the cathode and anode.

Figure 8:
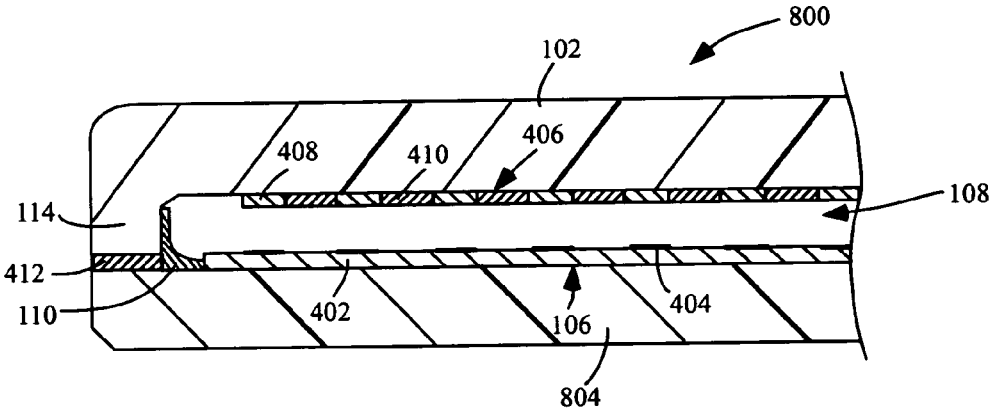
FIG. 8 is a partial cross sectional view of another variation of the FED of FIGS. 2 and 4 in which the cathode substrate is positioned directly on the backplate of the FED.

Referring next to FIG. 8, a partial cross sectional view is shown of another variation of the FED of FIGS. 2 and 4 in which the cathode substrate 402 is positioned directly on the backplate 804 of the FED 800. The backplate 804 is preferably a flat plate without frame supports or ridge portions as described herein. Thus, there is no additional portion of the volume between the non-emitting surface of the cathode 106 and the interior surface of the backplate 804. The volume 108 occupies the space in between the cathode 106 and the anode 406 between the faceplate 102 and the backplate 804. The thickness of the faceplate 102 and the backplate 804 is advantageously designed such that the mechanical strength of the plates will maintain the uniform separation between the cathode 106 and anode 406 across the dimensions of the plates; thus, spacers are not required. However, this embodiment lacks the additional benefits provided by the increase volume, i.e., increased ratio of volume to surface area for improved gettering and improved FED lifetime. On the other hand, the overall thickness of the FED 800 of FIG. 8 is slightly less than an FED containing the additional volume portion 430.

The getter 110 is deposited within the volume 108, but on the interior surfaces of the ridge portion 114 and exposed interior surfaces of the backplate 804. It is noted that a portion of the getter 110 may be located on periphery edges of the substrate itself, i.e., those edges not containing active regions 404. As can be easily seen, the FED 800 provides for significantly less getter material than the embodiments including the additional volume portion 430.

Figure 9:
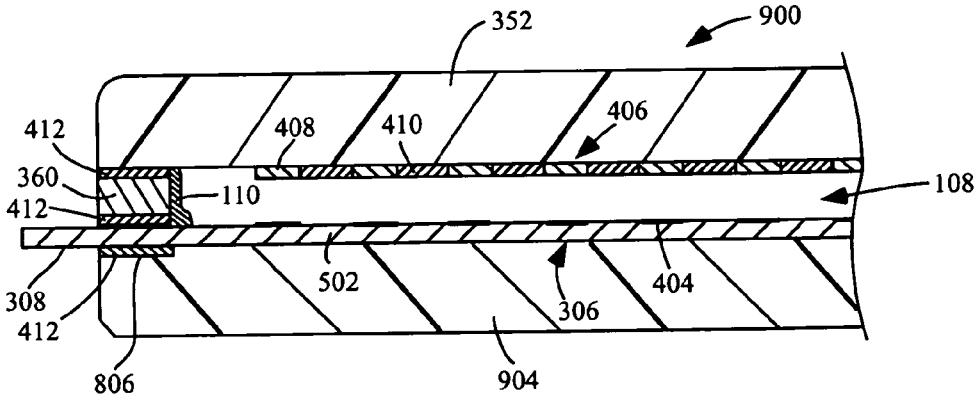
FIG. 9 is a partial cross sectional view of another variation of the FED of FIGS. 3B and 5B in which the cathode substrate is positioned directly on the backplate of the FED.

Referring next to FIG. 9, a partial cross sectional view is shown of another variation of the FED of FIGS. 3B and 5B in which the cathode substrate 502 is positioned directly on the backplate 904 of the FED 900. Similar to the FED 800 of FIG. 8, there is no additional portion of the volume between the non-emitting surface of the cathode 106 and the interior surface of the backplate 904. Advantageously, the thickness of the faceplate 352 and the backplate 904 is designed such that the mechanical strength of the plates will maintain the uniform separation between the cathode 306 and anode 406 across the dimensions of the plates; thus, spacers are not required. However, this embodiment also lacks the additional benefits described above provided by the increase in volume. On the other hand, the overall thickness of the FED 900 of FIG. 9 is slightly less than an FED containing the additional volume portion 430.

Additionally, the getter 110 is deposited within the volume 108, but on the interior surfaces of the frame support 360 and on the periphery edges of the substrate 502 itself. As can be easily seen, the FED 900 provides for significantly less getter material than the embodiments including the additional volume portion 430.

It is noted that the FED 900 includes a frame support 360 to provide the separation between the anode 406 and the cathode 106. However, it is understood that the faceplate 352 may alternatively include a ridge portion. Furthermore, the sealant 412 is formed in between the faceplate 352, the frame support 360, the substrate 502 and the backplate 904. The sealant 412 in between the backplate 904 and the substrate 502 is illustrated as formed within a recess 806 formed about the perimeter of the backplate 904 in order that there is no volume in between the substrate 502 and the backplate 904. Optionally, the cathode emitting surface (e.g., the active regions 404 ) may be formed directly on the backplate 904 without requiring a substrate 502. It is also noted that the holes 358 of the FED 350 of FIG. 3B and 5B are not needed since there is no additional volume portion 430.

Alternatively, the cathode substrates 402 and 502 of the embodiments of FIGS. 8 and 9 are made thick enough (and of a sufficiently rigid material, such as ceramic) to withstand the vacuum pressure without the use of a separate backplate 904. Thus, in such embodiments, the substrate functions as both substrate and backplate.

Figure 10:
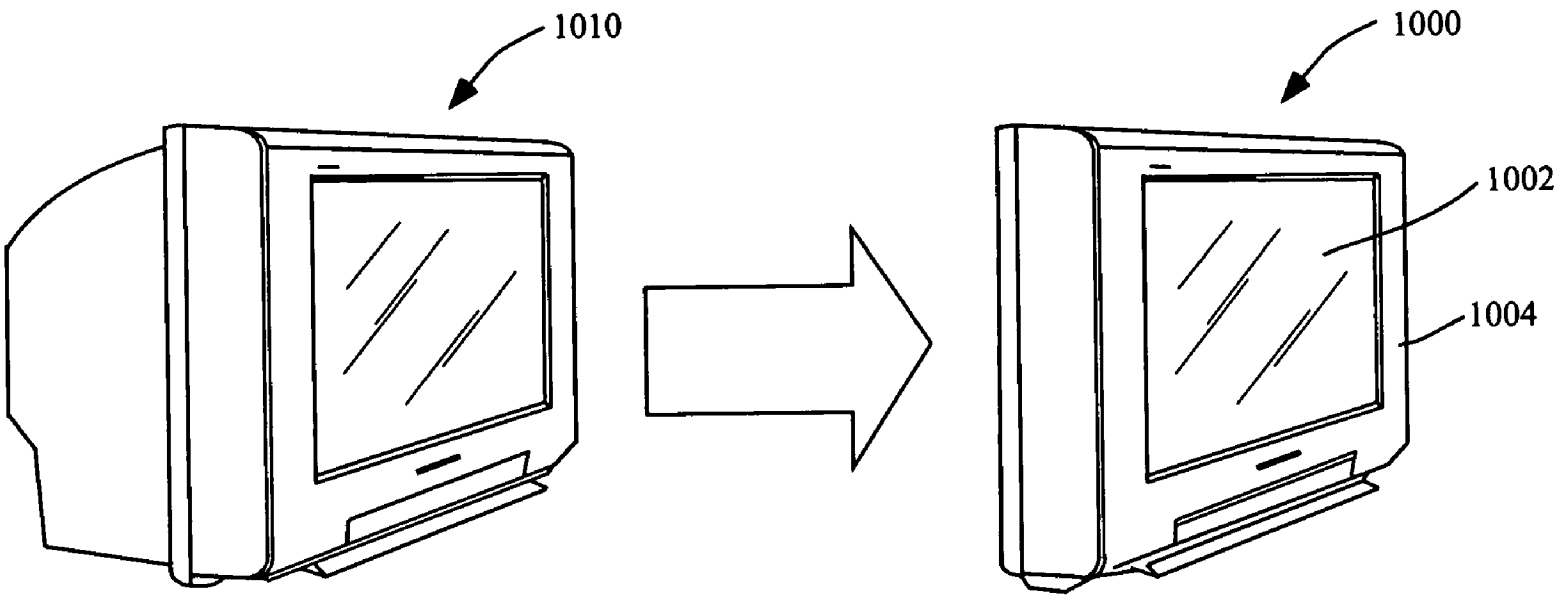
FIG. 10 is a perspective view of a conventional cathode ray tube (CRT) television and an FED-based television using a spacer-less FED in accordance with the present invention.

Referring next to FIG. 10, a perspective is shown of a conventional CRT-based television 1010 and an FED-based television 1000. In a preferred form, the faceplate 1002 of the television 1000 has a size of approximately 35 inches. The FED contained with the housing 1004 is made in accordance with one or more embodiments of the invention. For example, the faceplate 1002 and the backplate are designed to be sufficiently thick such that spacers are not required. Advantageously, the overall FED for a 35 inch television is approximately 4 inches thick and the resulting television 1000 may be as thin as 4–6 inches. Advantageously, the television 1000 is significantly thinner than conventional CRT based televisions 1010 of similar screen size, for example, a 35 inch CRT television may be 24 inches deep. Therefore, the television 1000 is comparable in overall thickness to existing LCD and plasma based televisions. Additionally, since spacers are not used at all, the picture quality of such a television 1000 is equivalent to that of CRT-based televisions; however, with significantly less overall thickness.

Again, due to the additional thickness of the faceplate and the backplate according to several embodiments of the invention, such thicker FEDs are not useful in traditional thin screen display implementations in which the display must be very thin, e.g., less than 10–15 mm. However, scaled down versions of the present invention may be implemented in displays that are thin, but not necessarily as thin as traditional thin FED displays. For example, spacerless FEDs according to several embodiments may be implemented in devices as small screen displays in which the overall device is not required to be thin, i.e., the thickness of the FED display device does not cause the device to have to be made thicker than preferable for its intended use.

TABLE 1 provides a minimum thickness of the faceplate and a flat plate backplate each made of glass for a given screen size in order to avoid the use of spacers. Again, this is in contrast to traditional FEDs, the faceplate of which is typically about 1 mm and which requires the use of spacers. Furthermore, FED-type displays are made that are larger than the largest conventional FED displays, e.g., larger than 10–12 inches. It is noted that the backplate may be made slightly thinner if slightly angled to provide better mechanical strength.

TABLE 1

| screen size (in.) | faceplate thickness (mm) |
|---|---|
| 35 | 10 |
| 21 | 9 |
| 14 | 7 |
| 12 | 6 |
| 10 | 5 |
| 5 | 3 |
| 2 | 2 |

While the invention herein disclosed has been described by means of specific embodiments and applications thereof, numerous modifications and variations could be made thereto by those skilled in the art without departing from the scope of the invention set forth in the claims.

What is claimed is:

1. A field emission display comprising;

a faceplate;

a backplate spaced apart from the faceplate;

a volume formed in between the faceplate and the backplate, the volume maintained as a vacuum;

a cathode having a cathode substrate and active cathode regions on the cathode substrate, at least a portion of the cathode substrate sealed within the volume; and an anode including phosphor materials and sealed within the volume;

wherein a thickness of the faceplate and a thickness of the backplate are sufficient to prevent deformation of the faceplate and the backplate across the dimensions of the faceplate and the backplate due to the vacuum such that spacers are not needed within the volume in order to maintain a uniform separation between the anode and the active cathode regions in the vacuum;

wherein the volume comprises:

a first portion in between the cathode substrate and the anode; and a second portion in between the cathode substrate and the backplate, the second portion continuous with the first portion;

wherein the second portion is larger than the first portion.

2. The display of claim 1 further comprising a getter material located within the second portion of the volume.

3. The display of claim 1 wherein the faceplate has a diagonal screen size of approximately 35 inches and a thickness between a range of approximately 10 to 30 millimeters.

4. The display of claim 1 wherein the faceplate has a diagonal screen size greater than 12 inches and a thickness greater than 6 millimeters.

5. The display of claim 1 wherein a periphery portion of the cathode substrate extends outside of the volume in order to provide easier electrical connection to the cathode substrate.

6. The display of claim 1 wherein all portions of the cathode substrate are sealed within the volume.

7. The display of claim 1 further comprising a support structure for holding the cathode substrate within the volume and separate from the anode and the backplate.

8. The display of claim 1 wherein the anode is formed on an interior surface of the faceplate.

9. The display of claim 1 wherein the cathode substrate is positioned on the backplate.

10. A field emission display comnprising:

a faceplate;

a backplate spaced apart from the faceplate;

a volume formed in between the faceplate and the backplate, the volume maintained as a vacuum;

a cathode having a cathode substrate and active cathode regions on the cathode substrate, at least a portion of the cathode substrate sealed within the volume; and anode including phosphor materials and sealed within the volume;

wherein the volume comprises:

a first portion in between the cathode substrate and the anode; and a second portion in between the cathode substrate and the backplate, the second portion continuous with the first portion;

wherein the second portion is larger than the first portion.

11. The display of claim 10 wherein a ratio of the volume to surface area of exposed surfaces in the volume is increased relative to the ratio of the volume to surface area of the first portion alone.

12. The display of claim 10 further comprising a getter material located within the second portion of the volume.

13. The display of claim 10 wherein at least one hole is formed in the cathode substrate to allow the first portion and the second portion to be continuous.

14. The display of claim 10 wherein an outer edge of the cathode substrate does not extend a full length of the faceplate to allow the first portion and the second portion to be continuous.

15. The display of claim 10 wherein the faceplate further comprises a ridge portion formed about an outer periphery of the faceplate and for creating at least a portion of a separation between the faceplate and the backplate defining at least a portion of the volume.

16. The display of claim 10 further comprising a frame support coupled to the faceplate for creating at least a portion of a separation between the faceplate and the backplate defining at least a portion of the volume.

17. The display of claim 16 wherein the frame support couples to the faceplate and the backplate for creating at least the portion of the separation between the faceplate and the backplate defining at least a portion of the volume.

18. The display of claim 10 wherein the backplate further comprises a ridge portion formed about an outer periphery edge and for creating at least a portion of separation between the backplate and the faceplate defining at least a portion of the volume.

19. The display of claim 10 farther comprising a frame support structure coupled to the backplate for creating at least a portion of a separation between the backplate and the faceplate defining at least a portion of the volume.

20. A field emission display comprising;

a faceplate;

a backplate spaced apart from the faceplate;

a volume formed in between the faceplate and the backplate, the volume maintained as a vacuum;

a cathode having a cathode substrate and active cathode regions on the cathode substrate, at least a portion of the cathode substrate sealed within the volume; and an anode including phosphor materials and sealed within the volume;

wherein a thickness of the faceplate and a thickness of the backplate are sufficient to prevent deformation of the faceplate and the backplate across the dimensions of the faceplate and the backplate due to the vacuum such that spacers are not needed within the volume in order to maintain a uniform separation between the anode and the active cathode regions in the vacuum;

wherein the anode comprises an anode plate, the display further comprising a support structure for supporting the anode plate within the volume.

21. The display of claim 20 wherein the volume comprises:

a first portion in between the cathode substrate and the anode; and a second portion in between the cathode substrate and the backplate, the second portion continuous with the first portion.

22. The display of claim 21 further comprising a getter material located within the second portion of the volume.

23. The display of claim 20 wherein the faceplate has a diagonal screen size of approximately 35 inches and a thickness between a range of approximately 10 to 30 millimeters.

24. The display of claim 20 wherein the faceplate has a diagonal screen size greater than 12 inches and a thickness greater than 6 millimeters.

25. The display of claim 20 wherein a periphery portion of the cathode substrate extends outside of the volume in order to provide easier electrical connection to the cathode substrate.

26. The display of claim 20 wherein all portions of the cathode substrate are sealed within the volume.

27. The display of claim 20 further comprising a cathode support structure for holding the cathode substrate within the volume and separate from the anode and the backplate.

28. The display of claim 20 wherein the cathode substrate is positioned on the backplate.

29. A field emission display comprising:

a faceplate;

a backplate spaced apart from the faceplate;

a volume formed in between the faceplate and the backplate, the volume maintained as a vacuum;

a cathode having a cathode substrate and active cathode regions on the cathode substrate, at least a portion of the cathode substrate sealed within the volume;

an anode including phosphor materials and sealed within the volume;

wherein the volume comprises:

a first portion in between the cathode substrate and the anode; and a second portion in between the cathode substrate and the backplate, the second portion continuous with the first portion; and a getter material located within the second portion of the volume;

wherein a getter region for locating the getter within the second portion is larger than a getter region of the first portion.

30. The display of claim 29 wherein a thickness of the faceplate and a thickness of the backplate are sufficient to prevent deformation of the faceplate and the backplate across the dimensions of the faceplate and the backplate due to the vacuum such that spacers are not needed within the volume in order to maintain a uniform separation between the anode and the active cathode regions in the vacuum.

* * * * *

UNITED STATES PATENT AND TRADEMARK OFFICE

CERTIFICATE OF CORRECTION

PATENT NO. : 7,012,582 B2
APPLICATION NO. : 10/306172
DATED : March 14, 2006
INVENTOR(S) : Russ et al.

It is certified that error appears in the above-identified patent and that said Letters Patent is hereby corrected as shown below:

In the CLAIMS:

Claim 1, column 16, line 51, delete “comprising;” and insert --comprising:--.

Claim 10, column 17, line 30, delete “comnprising:” and insert --comprising:--.

Claim 10, column 17, line 39, insert --an-- before “anode”.

Claim 19, column 18, line 12, delete “farther” and insert --further--.

Claim 20, column 18, line 16, delete “comprising;” and insert --comprising:--.

Signed and Sealed this

Nineteenth Day of December, 2006

JON W. DUDAS
*Director of the United States Patent and Trademark Office*